United States Patent [19]

Davis

[11] Patent Number: 4,461,391

[45] Date of Patent: Jul. 24, 1984

[54] TAMPER-RESISTANT SCREW CLOSURE

[75] Inventor: Eugene E. Davis, Essex, England

[73] Assignee: Johnsen & Jorgensen (Plastics) Limited Company, England

[21] Appl. No.: 444,742

[22] Filed: Nov. 26, 1982

[30] Foreign Application Priority Data

Nov. 30, 1981 [GB] United Kingdom ..... 8136095

[51] Int. Cl.[3] ..... B65D 41/34

[52] U.S. Cl. ..... 215/252

[58] Field of Search ..... 215/252

[56] References Cited

U.S. PATENT DOCUMENTS 3,329,295 7/1967 Fields ..... 215/252

4,299,328 11/1981 Ochs et al. ..... 215/252

4,352,436 10/1982 Chartier ..... 215/252

FOREIGN PATENT DOCUMENTS 1536459 7/1968 France ..... 215/252

*Primary Examiner*—Donald F. Norton

*Attorney, Agent, or Firm*—Newton, Hopkins & Ormsby

[57] ABSTRACT

A tamper-resistant screw closure for a bottle or the like having an external screw thread in which a cap with a top and a depending skirt and a tamper-resistant band below the skirt has spaced apart frangible tongues connecting with the skirt and the tamper-resistant band and the tamper-resistant band has internal projections engaging below the external projecting means on the bottle to resist movement of the band when the closure is unscrewed so that the frangible tongues break to show that the closure has been removed.

5 Claims, 4 Drawing Figures

TAMPER-RESISTANT SCREW CLOSURE

This invention relates to the provision of a tamper-resistant screw closure for use with an associated container of the type having a body to hold the contents of the container, a mouth through which the contents can be dispensed, an external screw thread adjacent to the mouth and external projecting means below the screw thread and in this specification a container of this type is referred to as a substantially normal container which may be, for example, a bottle for holding pills or tablets.

There is a demand for a tamper-resistant screw closure of relatively simple design capable of being used with a substantially normal container. There have, in fact, been many previous proposals for the provision of tamper-resistant screw closures for co-operation with specially shaped bottles, for example using co-operating ratchet and pawl mechanism, one co-operating part being on the closure and the other part being on the bottle. These have been satisfactory in operation but have been expensive to produce due to the requirement for the provision of a special bottle. It is an object of the present invention to provide a tamper-resistant screw closure for use with a substantially normal container e.g. a bottle. According to the present invention, in its broadest aspect, there is provided a tamper resistant screw closure for application to a container of the type described in order to close the mouth of the container wherein the closure comprises (a) a cap part with a top and a depending skirt and (b) a tamper-resistant band below the skirt characterised in that the tamper-resistant band is connected to the skirt of the cap part of the closure by a plurality of spaced apart frangible tongues and that the tamper-resistant band is provided with internal projecting means adapted and positioned to engage below the external projecting means on the container to resist upward movement of the tamper-resistant band when the closure is unscrewed so that the frangible tongues break and show that the closure has been removed. Preferably the internal projecting means on the closure and the external projecting means on the container are in the form of annular rings shaped so that they will readily engage when the closure is screwed on to the container but will resist disengagement when the closure is unscrewed.

If desired, the bottom of the skirt of the cap part of the closure and the top of the tamper-resistant band may have cooperating ratchet teeth or serrations to facilitate operation of the closure. The invention therefore includes a tamper-resistant screw closure for application to a container of the type described in order to close the mouth thereof wherein the closure comprises (a) a cap part with a top and a depending skirt and (b) a tamper-resistant band below the skirt characterised in that the tamper-resistant band is connected to the bottom of the skirt by a plurality of frangible connecting tongues and that the tamper-resistant band is provided with internal projecting means to engage with external projecting means on the container to resist upward movement of the tamper-resistant band when the closure is unscrewed and further characterised in that the bottom of the skirt of the cap part has ratchet teeth for engagement with co-operating ratchet teeth on the top of the tamper-resistant band in such a way that when the closure is screwed on to a container the ratchet teeth engage and the band turns with the cap part but when the closure is unscrewed the teeth on the cap part move out of engagement with the teeth on the band and the frangible tongues are broken.

In order that the invention may be more clearly understood, reference is now directed to the accompanying drawings given by way of example in which.

Figure 1:
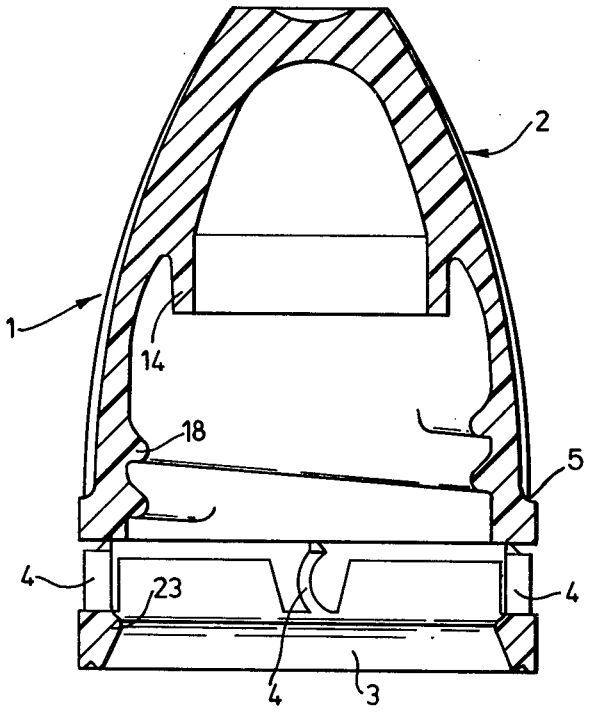
FIG. 1 is a sectional view of one embodiment of the invention.

Referring first to FIG. 1 a closure 1 comprises a cap part 2 and a tamper-resistant band 3 connected to the cap part 2 by frangible tongues 4. The cap part 2 has a skirt 5 and a depending annular sealing projection 14 to rest on a part of a container and an internal screw thread 18 for cooperation with a screw thread on the container. The tamper resistant band has an internal bulbous annular bead 23 for cooperation with an external bead on a container, not shown in FIG. 1. The operation of the closure will be described after referring to the other Figures.

Figure 2:
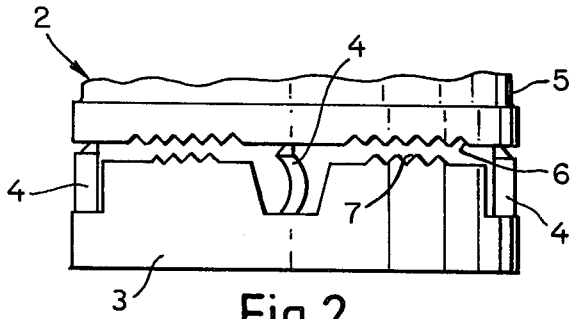
FIG. 2 is a detail view of a modification.

FIG. 2 differs from FIG. 1 only in that the bottom of the skirt 5 of the cap part has serrations or teeth 6 for co-operation with serrations or teeth 7 on the top of the band 3.

Figure 3:
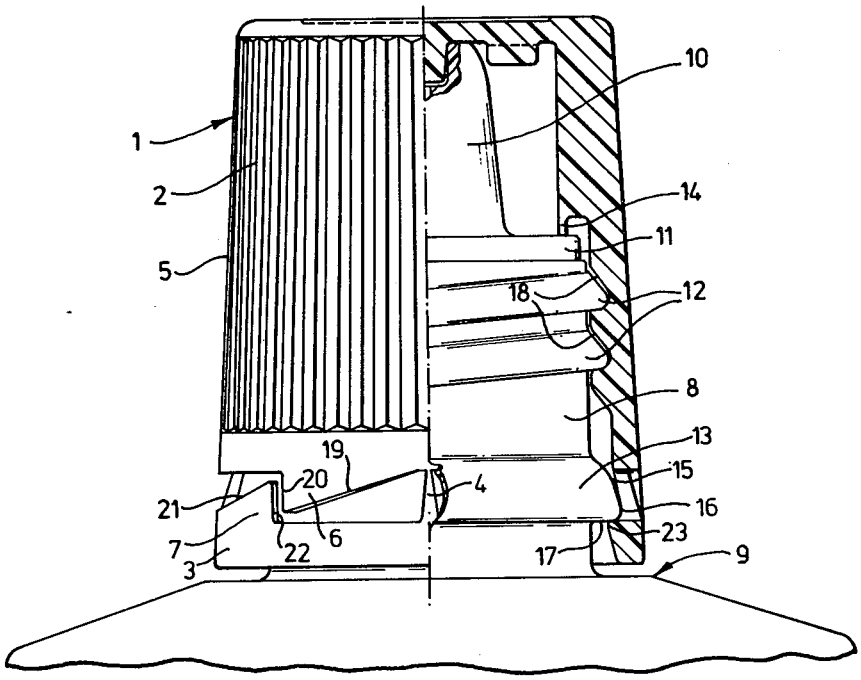
FIG. 3 is a sectional view of a second embodiment.

Referring now to FIG. 3 a closure 1 comprises a cap part 2 and a tamper-resistant band 3 connected to the cap part 2 by frangible tongues 4. The bottom edge of the skirt 5 of the cap part 2 has ratchet teeth 6 projecting downwardly for co-operation with ratchet teeth 7 projecting upwardly from the band 3. FIG. 3 shows the closure 1 in position on the neck 8 of a bottle 9. The bottle 9 is of substantially normal shape, that is to say that it is more or less one of a number of standard designs of bottle that can readily be obtained from bottle manufacturers. The bottle 9 is shown with a top attachment 10 of reduced diameter specially adapted for pouring or for use as a dropper. The bottle itself has an annular flange 11, a screw thread 12 and an annular retaining bead 13. The attachment and the inside surface of the top of the cap part 2 of the closure 1 may be shaped as shown in FIG. 3 but form no part of the present invention. The flange 11 is substantially flat at the top around the mouth of the bottle to receive a depending annular sealing projection 14 on the closure 1. The bead 13 is nose shaped in section and slopes gently downwardly and outwardly on its upper surface 15 with a rounded end 16 and a substantially horizontal lower surface 17.

The closure is shaped internally as shown in FIG. 3 and includes the projection 14, a screw thread 18 for co-operation with the screw thread 12 and the ratchet teeth 6 each of which has a sloping trailing edge 19 and a substantially vertical leading edge 20. The band 3 includes the ratchet teeth 7 each of which has a sloping leading edge 21 and a substantially vertical trailing edge 22. The band also has an internal annular bulbous bead 23 for co-operation with the bead 13.

In operation when the closure 1 is applied to a container e.g. the bottle 9 the thread on the closure engages with the thread on the bottle and as the closure is moved downwardly, turning on its vertical axis as it does so, the vertical leading edges 20 on the teeth 6 engage with the vertical trailing edges 22 on the teeth 7 so that the movement of the cap part 2 drives the band 3 around with it and the nibs 4 remain unbroken. The closure reaches its operative position when the bead 23 has passed over the bead 13 into the position shown in FIG. 2. It will be understood that the closure is made of suitably flexible and resilient material e.g. a plastics material such as polypropylene, so that on the downward movement of the closure the band 3 will be deformed and the bead 23 will slide over the bead 13. The bead 23 on the band will return to its normal position after the bead 23 has passed below the bead 13. When in this position as shown in FIG. 2 the band 3 is connected to the cap part 2 by the tongues 4 and if on inspection it is noted that the tongues 4 are intact then that fact indicates that the container and its contents have not been tampered with.

When it is desired to open the container the closure is turned in a direction to unscrew it by manipulation of the cap part 2 so that the closure tends to rise in FIG. 3 which causes the edges 20 to move away from the edges 22 with the sloping edges 19 sliding on the sloping edges 21. This movement exerts an upward pull on the tongues 4 which try to pull the band 3 upwardly with the cap part. However the engagement of the bead 23 below the bead 13 prevents the band 3 rising so that the tongues break and the cap part can be removed leaving the band stranded on the container in the manner of a collar.

Therefore, if it be observed by a user that the tongues have been broken that is evidence that the closure and possibly the contents of the container have been tampered with.

As described above manipulation of the closure 1 is effected, in accordance with normal practice, by gripping and turning the closure and naturally a user will grip the cap part which is therefore preferably roughened or serrated as shown, on its outer surface to facilitate manipulation.

It will be appreciated that the precise number of the teeth 6 and 7 provided is not critical but the provision of four equispaced pairs of teeth i.e. drive-on ratchets and four equispaced tongues 4 is a convenient arrangement and is as illustrated in the drawings.

We have referred above to the bottle as being substantially of normal or standard shape. We have used the word substantially in this connection because it may be necessary in some cases to modify the normal shape of the bead 13 to provide an effective sealing on the underside for the bead 23 so that the bead 23 cannot slip over the bead 13 in an upward direction. However modification of the bead 13 is a relatively simple and inexpensive operation compared with the provision of special teeth or the like on the bottle neck.

We should make clear that the use of the attachment 10 is not significant and it is included simply as an Example. The cap may certainly be used with a bottle without the attachment. In the embodiment illustrated the cap has a plug which fits into a central opening in the attachment for sealing purposes.

Figure 4:
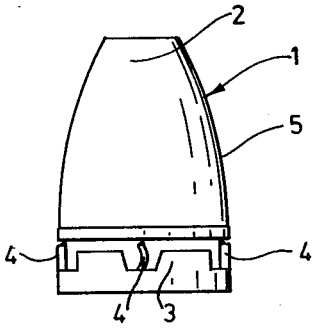
FIG. 4 is a side elevation of the embodiment shown in FIG. 1 drawn to a smaller scale.

The operation of the embodiments described in connection with FIGS. 1, 2 and 4 is similar to the operation of the embodiment of FIG. 3 except that the ratchet teeth cooperation is not used. In the embodiment of FIGS. 1 and 4, the engagement of the bead 23 with the bead 13 is sufficiently positive to prevent the band 3 from rising when the closure is unscrewed. In the embodiment of FIG. 2 the teeth 6 and 7 are provided as an additional safeguard; the teeth will tend to engage as the closure 1 is screwed on to the bottle and will tend to disengage as the closure is unscrewed. This means that the teeth 6 on the skirt will tend to drive the band round with the cap part as the closure is screwed on but the teeth 6 and 7 will tend to disengage as the closure is unscrewed, the band will be left behind and the tongues will break.

In FIGS. 1 and 2 the tongues 4 are shown as bow-shaped in side view to allow a certain amount of "play" when screwing a closure on to a container, just in case there is a little relative movement between the cap part and the skirt especially in the FIG. 1 embodiment. It will be realised that unwanted movement of one part of the closure relatively to the other screwing on the cap could lead to breaking of the tongues which would give an incorrect indication that the container had been tampered with.

I claim:

1. A tamper-resistant screw closure for application to a container of the type described in order to close the mouth thereof wherein the closure comprises (a) a cap part with a top and a depending skirt with a lower marginal edge (b) a tamper resistant band with an upper marginal edge below the skirt and provided with internal projecting means to engage with external projecting means on the container to resist upward movement of the tamper resistant band when the closure is unscrewed characterized in that the tamper resistant band is connected to the skirt of the cap part by elongate frangible tongues spaced apart around the closure and arranged to extend substantially vertically relative to the closure and further characterized in that the lower marginal edge of the skirt of the cap part and the upper marginal edge of the band each have a plurality of spaced apart rows of engageable, serrated teeth disposed between adjacent tongues.

2. A tamper-resistant screw closure according to claim 1 characterized in that the tongues are of bow shape so as to allow a small degree of relative movement between the cap and the band without breaking said frangible tongues.

3. A tamper-resistant screw closure according to claim 2 characterized in that the internal projecting means on the tamper indicating band and the external projecting means on the container are in the form of annular rings.

4. A tamper-resistant screw closure according to claim 3 characterized in that the annular ring on the band is bulbous in shape.

5. A tamper-resistant screw closure according to claim 2 characterized in that the annular ring on the container is nose shaped in section in that it slopes gently downwardly on its upper surface and has a substantially horizontal lower surface.

* * * * *